US007806668B2

(12) United States Patent
Yajima

(10) Patent No.: US 7,806,668 B2
(45) Date of Patent: Oct. 5, 2010

(54) FLEXIBLE TUBE FOR SUPPLYING CHEMICAL LIQUID

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 1040 days.

(21) Appl. No.: 10/571,550

(22) PCT Filed: Jan. 30, 2004

(86) PCT No.: PCT/JP2004/000946

§ 371 (c)(1),
(2), (4) Date: Mar. 10, 2006

(87) PCT Pub. No.: WO2005/026549

PCT Pub. Date: Mar. 24, 2005

(65) Prior Publication Data

US 2007/0031273 A1 Feb. 8, 2007

(30) Foreign Application Priority Data

Sep. 11, 2003 (JP) ..... 2003-319671

(51) Int. Cl.
*F04B 9/08* (2006.01)
*F04B 35/02* (2006.01)
*F04B 43/08* (2006.01)
*F04B 43/12* (2006.01)

(52) U.S. Cl. ..... 417/383; 417/474

(58) Field of Classification Search ..... 417/474, 417/475, 478, 479, 383, 389
See application file for complete search history.

(56) References Cited

U.S. PATENT DOCUMENTS 2,365,668 A * 12/1944 Wakefield ..... 139/247
3,004,330 A * 10/1961 Wilkins ..... 29/890.053

(Continued)

FOREIGN PATENT DOCUMENTS

JP 48-40169 11/1973

(Continued)

OTHER PUBLICATIONS

Office Action dated Aug. 24, 2007 issued by Chinese Patent Office in corresponding Chinese application.

*Primary Examiner*—Devon C Kramer
*Assistant Examiner*—Peter J Bertheaud
(74) *Attorney, Agent, or Firm*—McCormick, Paulding & Huber LLP

(57) ABSTRACT

A flexible tube 20 has an inlet side fixed end 21, and an outlet side fixed end 22, and an elastic deformation portion 23 is provided between them. The elastic deformation portion 23 is provided with convex arc portions 42. In the convex arc portions 42, three apices 41 provided apart at approximately regular intervals in the circumferential direction are each curved in a convex shape outward so as to have smaller curvature radius than that of a virtual circle S tangent to the apices 41 from each apex as a center for deformation. Concave arc portions 43 are formed consecutively between the respective convex arc portions 42 in circumferential direction, and the concave arc portions 43 are each curved in a concave shape outward. At a time of expansion and shrinkage of the elastic deformation portion, the respective convex arc portions 42 elastically deform in the circumferential direction, and the concave arc portions 43 elastically deform in the radial direction.

4 Claims, 6 Drawing Sheets

U.S. PATENT DOCUMENTS 3,062,153 A * 11/1962 Losey ..... 417/394
3,136,257 A * 6/1964 Smith et al. ..... 417/241
3,552,712 A * 1/1971 Whitlock ..... 251/5
4,268,005 A * 5/1981 Raftis et al. ..... 251/5
5,222,980 A * 6/1993 Gealow ..... 623/3.12
5,964,580 A * 10/1999 Taga ..... 417/394
6,183,223 B1 * 2/2001 Yajima ..... 417/478
6,575,715 B1 * 6/2003 Rastegar ..... 417/413.2

FOREIGN PATENT DOCUMENTS

| | | |
|---|---|---|
| JP | 10054366 | 2/1998 |
| JP | 11230048 | 8/1999 |
| JP | 2000234589 | 8/2000 |

* cited by examiner

FLEXIBLE TUBE FOR SUPPLYING CHEMICAL LIQUID

TECHNICAL FIELD

The present invention relates to a flexible tube used in a chemical liquid supply apparatus for discharging a specified amount of a liquid such as a chemical liquid.

BACKGROUND ART

In a manufacturing process of semiconductor devices or liquid crystal boards, a chemical agent such as a photoresist liquid is used. For example, to apply the photoresist liquid on a surface of a semiconductor wafer in the manufacturing process of semiconductor devices, the photoresist liquid is dropped on the surface of the semiconductor wafer in a state of rotating the semiconductor wafer in a horizontal plane. As a chemical liquid supply apparatus used for application of the photoresist liquid, there is developed a pump of such a type that a flexible tube is incorporated in an apparatus body and an expansion/shrinkage chamber is formed inside the flexible tube and a pressurizing chamber is formed outside the flexible tube, as conventionally disclosed in Patent Document 1. The pump of this type is also called a tube pump.

In such a chemical liquid supply apparatus, as disclosed in Japanese Patent Laid-Open Publication No. 11-230048 (Patent Document 1), there are a type in which an apparatus body is formed by a pipe or tube member and a pressurizing medium is supplied from an outside pump to a pressurizing chamber formed between the apparatus body and a flexible tube to vary a volume of the pressurizing chamber, and a type in which the apparatus body containing the flexible tube is provided with a small bellows and a large bellows mutually different in diameter and those bellows are deformed axially to vary the volume of the pressurizing chamber.

Also in either type, by expanding and shrinking the flexible tube to make the flexible tube operate like a pump, a liquid flowing into the tube from an inlet side can be discharged to the outside from an outlet side. The flexible tube includes a flat type, as described in Patent Document 1, in which a flat portion having an oval section formed in an elastic deformation portion of the flexible tube is expanded and shrunk, and a cylindrical type, as described in Japanese Patent Laid-Open Publication No. 2000-234589, in which a plurality of grooves extending axially are formed in a cylindrical elastic deformation portion.

To discharge the liquid from the tube outlet side to the outside, the volume of the pressurizing chamber is increased and the flexible tube is shrunk. Therefore, to keep a discharge rate constant, it is important that the flexible tube should be shrunk at a specific rate depending on an increase in the volume of the pressurizing chamber. Concurrently, to increase the volume of liquid capable of being discharged by one pump operation, it is important to increase a variation in the volume when being shrunk.

Incidentally, as described above, in the flat flexible tube whose elastic deformation portion has an approximately oval section, since the elastic deformation portion is formed by two semicircular portions and two straight portions for linking the semicircular portions, the two straight portions are elastically deformed so as to mainly approach to each other at a time of discharging the liquid, thereby making it possible to change the deformation amount of the flat portion at a specific rate depending on the increase in the volume of the pressurizing chamber. However, as the flat flexible tube is pressurized and shrunk, the straight portions come to contact with each other and even if being further shrunk, the pressurizing amount and the discharge amount cannot maintain a proportional relation therebetween, whereby the discharge amount becomes inaccurate. In addition, since having the long straight portions, the two semicircular portions are deformed on an outer-radial side when pressure is applied from the outside. At this time, a flat portion is deformed and shrunk so that its longitudinal-directional dimension becomes long. Therefore, the diameter of the apparatus body is required to be set large so that the flat portion may not contact with the apparatus body, that is, a housing for accommodating the flexible tube.

Meanwhile, as described above, in a flat tube in which the elastic deformation portion is formed into a cylindrical shape as a whole and a plurality of grooves extending axially are formed on an outer circumference surface thereof, to shrink the elastic deformation portion, each groove is deformed in an inner-radial direction, so that each circumferential width of four arc-shaped portions may be short. Therefore, the tube cannot be shrunk and deformed unless high pressure is applied to the pressurizing chamber. However, if the high pressure is applied for shrinkage and deformation, a pressure change rate of the pressurizing chamber and an elastic deformation rate of the elastic deformation portion may not be made constant depending on the deformation amount of the elastic deformation portion. Besides, discharge precision is influenced by pressure deformation of the housing or another element member between the housing and the pump. Therefore, to decrease the influence from those and enhance the discharge precision, it is preferred to apply smaller pressure to the pressurizing chamber.

To deform the flexible tube so that the discharge rate is constant throughout a discharge process from start to end of discharge, it is preferred to shrink the flexible tube by small pressure. However, since both ends of the flexible tube are fixed to a joint portion of the apparatus body and further the flexible tube is formed by a material such as a fluoro resin, i.e., a material having a smaller rate of elongation than that of silicone rubber or the like, it is necessary to apply larger pressure to the pressurizing chamber in order to deform the flexible tube by reducing the width of the arc-shaped portion. This pressure is not only changed depending on a deformation amount of the flexible tube but also transmitted to the apparatus body located on an outer side of the flexible tube, that is, the housing, which results in loss of the pressure. Therefore, a pressure change rate of the pressurizing chamber and an elastic deformation rate of the elastic deformation portion do not become constant, and these change rates vary depending on the deformation amount of the flexible tube. If there is a difference in the pressure change rates necessary for deforming the flexible tube between the start and end of discharge in the discharge process of the pump, the discharge rate is not made constant in all processes of liquid discharge and the discharge precision deteriorates.

An object of the present invention is to provide a flexible tube capable of discharging the liquid at the specific discharge amount and with high precision from start to end of discharge.

DISCLOSURE OF THE INVENTION

A flexible tube for supplying a chemical liquid according to the present invention is assembled in a chemical liquid supply apparatus and partitions an expansion/shrinkage chamber inside the apparatus and a pressurizing chamber outside it, wherein a tubular inlet side fixed end that is fixed to the chemical liquid supply apparatus, a tubular outlet side fixed end that is fixed to the chemical liquid supply apparatus, and an elastic deformation portion between the inlet side and outlet side fixed ends are provided in the flexible tube; convex arc portions whose deformation centers are three apices spaced apart at approximately regular intervals in a circumferential direction and which are curved in convex shapes so as to have a smaller curvature radius than that of a virtual circle tangent to the apices and project outward, and concave arc portions curved into concave shapes outward consecutively between the respective convex arc portions in a circumferential direction are formed in the elastic deformation portion; and at a time of expansion and shrinkage of the elastic deformation portion, the convex arc portions elastically deform in the circumferential direction from the apices as centers, and the concave arc portions elastically deform in a radial direction.

A flexible tube for supplying a chemical liquid according to the present invention is assembled in a chemical liquid supply apparatus and partitions an expansion/shrinkage chamber inside the apparatus and a pressurizing chamber outside it, wherein a tubular inlet side fixed end fixed to the chemical liquid supply apparatus, a tubular outlet side fixed end fixed to the chemical liquid supply apparatus, and an elastic deformation portion between the inlet and outlet side fixed ends are provided in the flexible tube; axial deformation portions curved in a radial direction, formed so as to extend in a circumferential direction, and deforming elastically in axial direction are formed in the elastic deformation portion; and the axial deformation portions are deformed elastically at a time of expansion and shrinkage of the elastic deformation portions.

The flexible tube for supplying a chemical liquid according to the present invention is such that the axial deformation portions are formed on all circumference of the elastic deformation portion. Or, the axial deformation portions are formed at both ends of the elastic deformation portion.

In the flexible tube of the present invention, at the time of expansion and shrinkage of the elastic deformation portion, each convex arc portion deforms elastically in the circumferential direction from the apex as a center, and the concave arc portion deforms elastically in the radial direction. Therefore, the volume change amount is large until an interior of the tube contacts when the elastic deformation portion shrinks, and the large volume of liquid can be discharged by one shrinking deformation. The deformation of the elastic deformation portion is made constant regardless of a state of deformation, and the specific discharge amount of liquid can be discharged with high accuracy from start to end of discharge, whereby discharge precision of the liquid can be enhanced. As compared with a conventional technique for obtaining the same discharge volume, the size of the housing can be reduced.

In the flexible tube of the present invention, the axial deformation portion deforming elastically in axial direction is formed in the elastic deformation portion so as to be curved in the radial direction and extend in the circumferential direction, and the axial deformation portion is deformed elastically when the elastic deformation portion expands and shrinks. Accordingly, the elastic deformation portion can be expanded and shrunk without increasing pressure applied from the outside of the flexible tube, whereby the discharge precision of liquid can be enhanced.

BEST MODE FOR CARRYING OUT THE INVENTION

Hereinafter, embodiments of the present invention will be specifically described with reference of the drawings.

Figure 1:
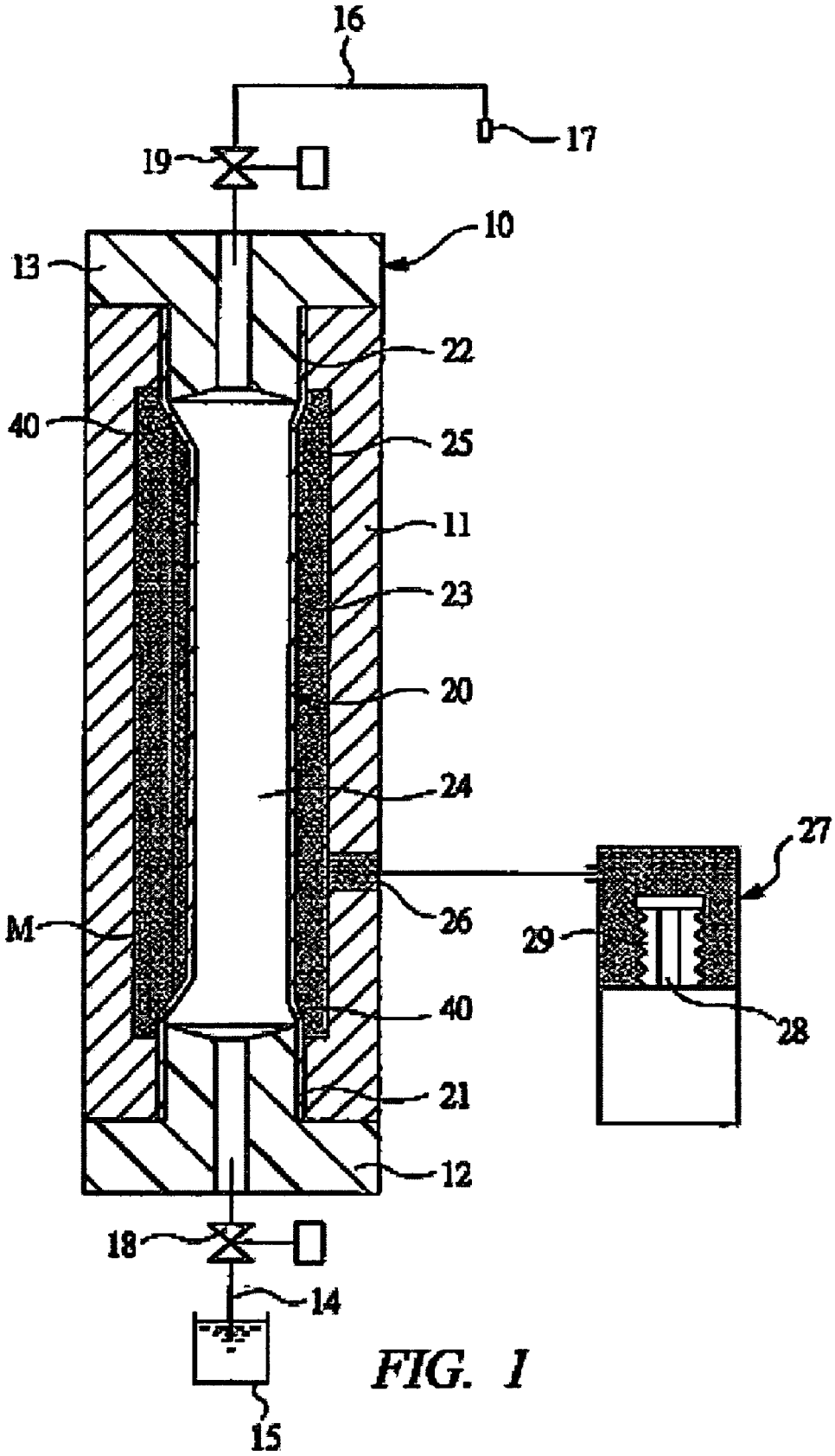
FIG. 1 is a sectional view of a chemical liquid supply apparatus using a flexible tube.

A chemical liquid supply apparatus shown in FIG. 1 has a tubular apparatus body, that is, a housing, and is of a type in which a pressurizing medium is supplied from an outside pump into a pressurizing chamber formed between the apparatus body and a flexible tube to vary a volume in the pressurizing chamber. As shown in FIG. 1, the housing 10 is formed by a cylinder 11, an inlet side joint 12 provided at one end thereof, and an outlet side joint 13 provided at the other end, wherein a supply side flow passage 14 is connected to the inlet side joint 12 and this supply side flow passage 14 is connected to a chemical liquid tank 15 serving as a chemical liquid container. A discharge side flow passage 16 is connected to the outlet side joint 13, and this discharge side flow passage 16 is connected to an application nozzle 17 as a chemical liquid discharge unit. When applying a photoresist liquid to a surface of a semiconductor wafer from the application nozzle 17, the photoresist liquid is contained in the chemical liquid tank 15.

A supply side opening/closing valve 18 for opening and closing the flow passage is provided in the supply side flow passage 14, and a discharge side opening/closing valve 19 for opening and closing the passage is provided in the discharge side flow passage 16. These valves 18, 19 may be solenoid valves operated by electrical signals or air-operated valves operated by air pressure, or may further be check valves.

A flexible tube 20 is assembled in the housing 10, and the flexible tube 20 includes a tubular inlet side fixed end 21 that is fixed in the inlet side joint 12, and a tubular outlet side fixed end 22 that is fixed to the outlet side joint 13, wherein an elastic deformation portion 23 is formed between the two fixed ends 21, 22. Since an expansion/shrinkage chamber 24 inside the flexible tube and a pressurizing chamber 25 outside the flexible tube are partitioned by the flexible tube 20, the pressurizing chamber 25 is formed between the housing 10 and the flexible tube 20. The pressurizing chamber 25 is filled with non-compressive fluid such as liquid serving as a pressurizing medium M, and the pressurizing medium M is supplied into the pressurizing chamber 25 from the outside through a supply port 26 formed in the housing 10. By pressurizing and supplying the pressurizing medium M into the pressurizing chamber 25, or by evacuating and discharging the pressuring medium M from the pressuring chamber 25, the flexible tube 20 is expanded and shrunk, and a pump 27 is connected to the supply port 26, so that this pump 27 has a bellows 29 attached to a rod 28 reciprocating linearly and, by reciprocating the rod 28 by driving means such as an electric motor or actuator, the flexible tube 20 expands and shrinks.

Therefore, when the pressurizing medium M is supplied into the pressurizing chamber 25 from the pump 27 in a state where the expansion/shrinkage chamber 24 is filled with liquid, the elastic deformation portion 23 of the flexible tube 20 is deformed for shrinkage and the expansion/shrinkage chamber 24 shrinks and the liquid is discharged from the application nozzle 17. At this time, the supply side opening/closing valve 18 is closed, and the discharge side opening/closing valve 19 is opened. On the other hand, when the pressurizing medium M in the pressurizing chamber 25 is discharged by the pump 27, the flexible tube 20 is deformed for expansion and the expansion/shrinkage chamber 24 expands and the liquid in the chemical liquid tank 15 flows into the expansion/shrinkage chamber 24. At this time, the supply side opening/closing valve 18 is opened, and the discharge side opening/closing valve 19 is closed. Thus, by expansion and shrinkage of the elastic deformation portion 23 of the flexible tube 20, the liquid in the chemical liquid tank 15 is sequentially sent into the application nozzle 17.

Figure 2:
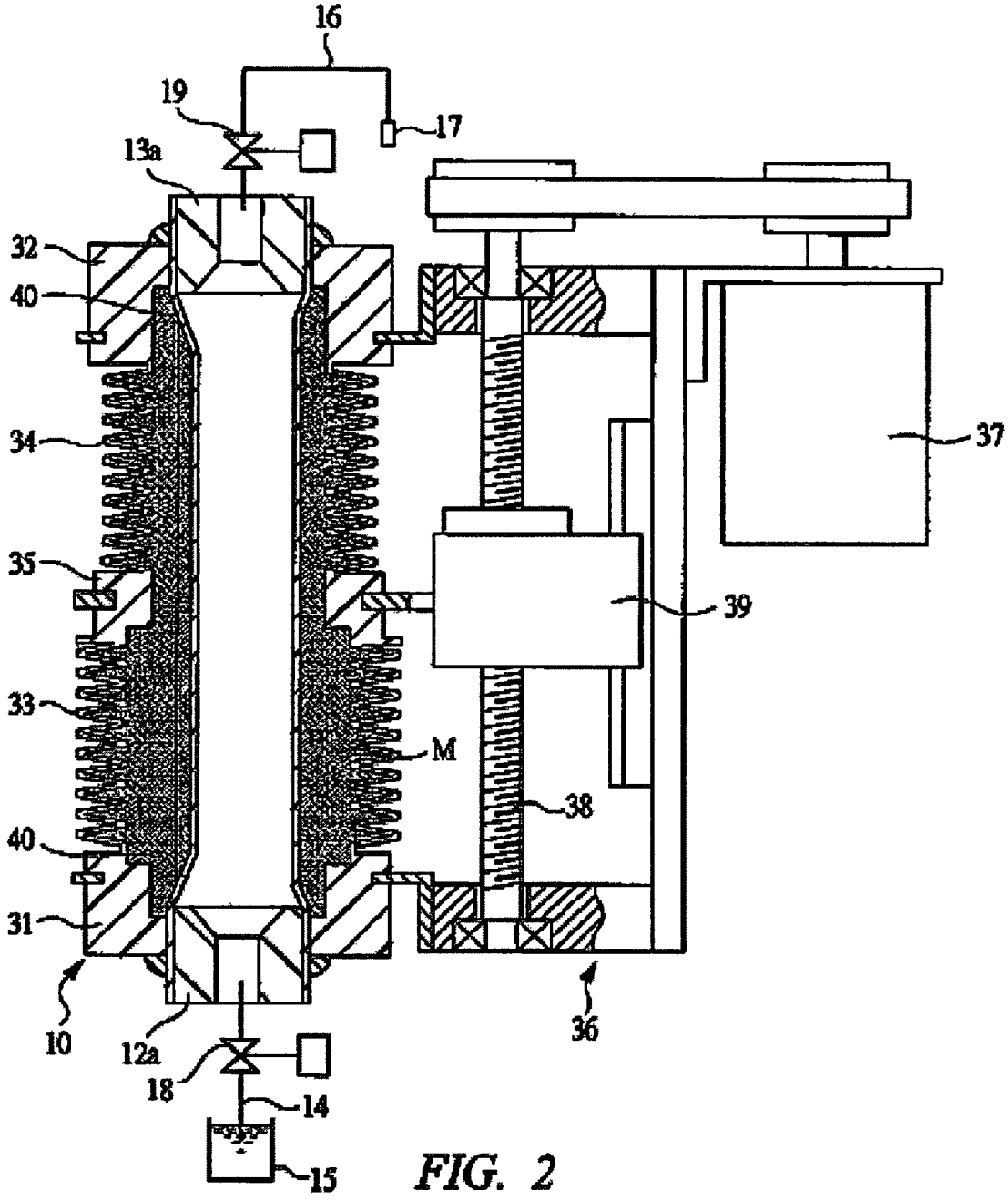
FIG. 2 is a sectional view of another type of chemical liquid supply apparatus using the flexible tube.

The chemical liquid supply apparatus shown in FIG. 2 is of a type in which a small bellows and a large bellows mutually different in diameter are provided in the apparatus body accommodating the flexible tube and the volume of the pressurizing chamber is varied by deforming these bellows axially. As shown in FIG. 2, the housing 10 includes a fixed disk 31 to which the inlet side joint 12*a* is attached, and a fixed disk 32 to which the outlet side joint 13*a* is attached. A large bellows 33 is provided in the fixed disk 31, and a small bellows 34 is provided in the fixed disk 32. An operating disk 35 is disposed between the two bellows 33, 34, and some members constituting the housing 10 are formed integrally with a resin. To vary the volume of the pressurizing chamber by deforming both the bellows 33, 34 axially, a pump drive unit 36 is provided to the housing 10. The pump drive unit 36 includes a ball screw 38 driven by a motor 37, and a ball nut 39 coupled to the ball screw 38 and engaged with the operating disk 35. Therefore, by linearly reciprocate the ball nut 39 by the motor 37, the elastic deformation portion 23 of the flexible tube 20 expands and shrinks and, like the chemical liquid supply apparatus shown in FIG. 1, the liquid in the chemical liquid tank 15 is sequentially sent into the application nozzle 17. Note that, in FIG. 2, members common to those in FIG. 1 are denoted by the same reference numerals.

FIGS. 3A to 3F each show one example of the flexible tube 20 assembled in the chemical liquid supply apparatus shown in FIG. 1 and FIG. 2, and this flexible tube 20 is integrally formed by a PFA (tetrafluoroethylene perfluoroalkyl vinyl ether copolymer) of a fluoro resin. The inlet side and outlet side fixed ends 21, 22 of the flexible tube 20 are fixed to the apparatus body, that is, the housing 10 and are each formed in a cylindrical shape to conform to a shape of each joint, and the elastic deformation portion 23 is formed between both the fixed ends 21, 22 through taper portions 40. Note that each of the fixed ends 21, 22 is not limited to a cylindrical shape and may be formed into a tetragonal or polygonal shape.

Figure 3A:
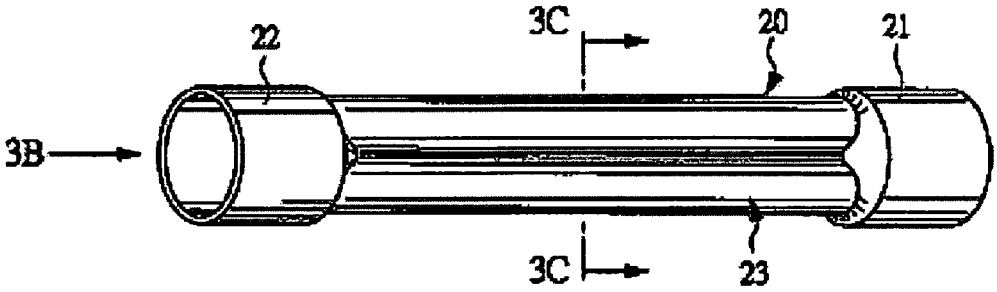
FIG. 3A is a perspective view of the flexible tube shown in FIG. 1 and FIG. 2.
Figure 3B:
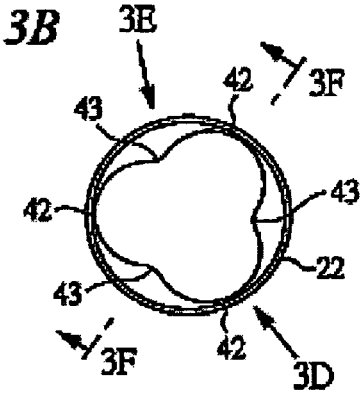
FIG. 3B is a view taken in a direction of an arrow 3B in FIG. 3A.
Figure 3C:
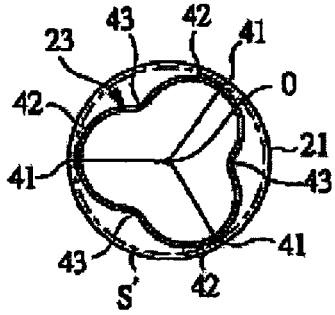
FIG. 3C is a sectional view taken along line 3C-3C in FIG. 3A.
Figure 3D:
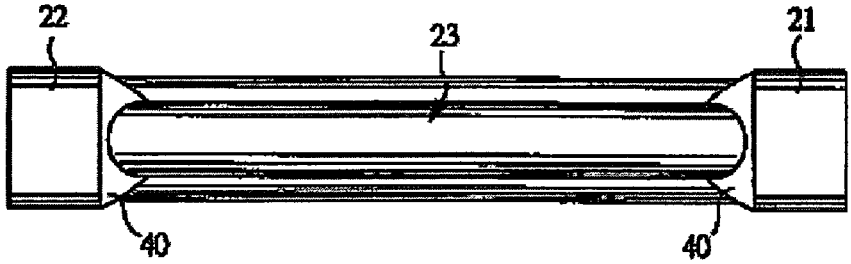
FIG. 3D is a view taken in a direction of an arrow 3D in FIG. 3B.
Figure 3E:
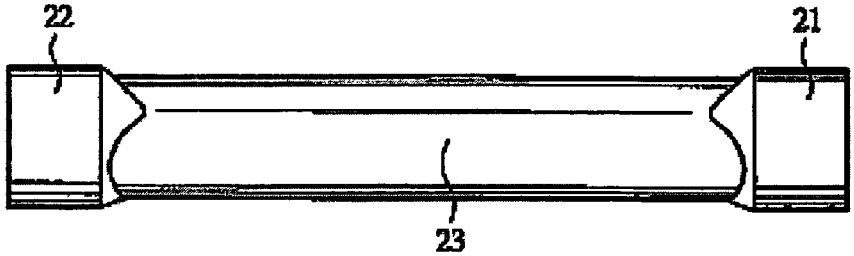
FIG. 3E is a view taken in a direction of an arrow 3E in FIG. 3B.
Figure 3F:
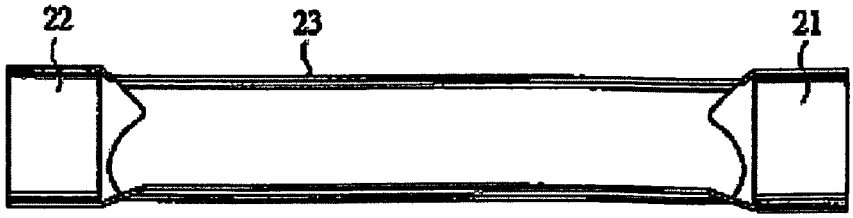
FIG. 3F is a sectional view taken along line 3F-3F in FIG. 3B.

The elastic deformation portion 23 has, as shown in FIG. 3C, three apices 41 provided at regular intervals in a circumferential direction and spaced approximately 120 degrees apart, and each apex 41 is at the same radial position from a center O of the flexible tube 20. The elastic deformation portion 23 has convex arc portions 42, each of which has a curvature radius smaller than that of a virtual circle S circumscribing three apices 41 and is curved outward in a convex shape. Three convex arc portions 42 are formed from the apex 41 as a center in circumferential direction so as to conform to the number of apices 41, and portions between the respective convex arc portions 42 in a circumferential direction are concave arc portions 43 curved in concave shapes outward consecutively thereto. Thus, in the elastic deformation portion 23 of the flexible tube 20, the convex arc portion 42 is provided between two concave arc portions 43 of three concave arc portions 43. In the convex arc portion 42, portions tangent to the virtual circumscribing circle S are the apices 41. Three convex arc portions 42 and three concave arc portions 43 each are formed alternately in the circumferential direction.

Figure 4A:
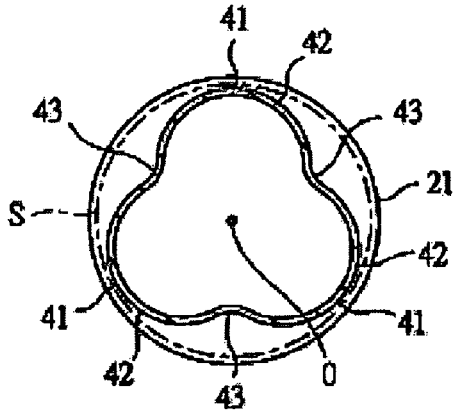
FIG. 4A is a sectional view showing a before-shrinkage state of an elastic deformation portion.
Figure 4B:
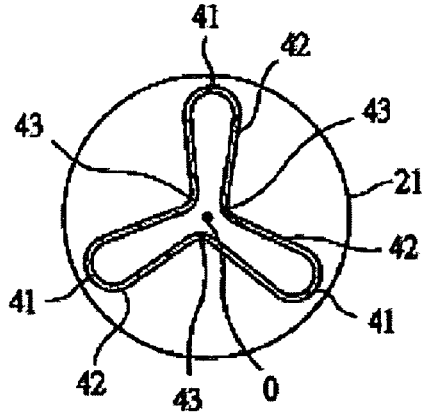
FIG. 4B is a sectional view of the shrunk elastic deformation portion.

FIG. 4A is a sectional view showing an expanded state where, similarly to the cases of FIGS. 3A to 3F, pressure from the outside is not applied to the flexible tube 20 and the elastic deformation portion 23 is spread by elasticity of the tube itself, and FIG. 4B shows a state where the pressure from the outside is applied to the flexible tube 20 and the elastic deformation portion 23 is contracted to the utmost extent. As shown in Figures, three convex arc portions 42 are formed at approximately regular intervals in the circumferential direction, and the curvature radius of each of the convex arc portions 42 is set smaller than that of the virtual circle S. Therefore, when the elastic deformation portion 23 shrinks, each of the convex arc portions 42 deforms elastically from the apex 41 as a center of deformation so that respective opposite surfaces of the convex arc portions 42 may approach to each other, that is, so as to be folded in the circumferential direction. At this time, the concave arc portions 43 elastically deform radially toward the center of flexible tube 20 in accordance with the elastic deformation of convex arc portions 42 in the circumferential direction. However, the apices 41 are not dislocated either inward or outward in the radial direction.

Thus, when the sectional shape of the elastic deformation portion 23 is trifoliate, a difference in a cross section before and after shrinking deformation can be increased, so that one shrinking operation of the flexible tube 20 can discharge a larger volume of liquid than that of the flat type. Moreover, when three apices 41 are provided, the respective apices 41 do not deform in the radial direction but slightly deform in an inner-radial direction and the apices 41 do not deform in an outer-radial direction, so that it is possible to downsize the housing 10 and, as a result, reduce the volume of pressurizing medium M.

In the above-mentioned flexible tube having the flat elastic deformation portion and in the flexible tube of the present invention, each discharge amount was measured. In making each measurement, the elastic deformation portions of the flexible tubes, which have the same axial-directional length, and the fixed ends of the flexible tubes, which have the same outside diameter, were used. As a result, the discharge volume of the flexible tube of the present invention became 1.5 times more than that of the flat flexible tube. When being shrunk to the utmost extent, the flexible tube of the present invention was 75% smaller in width at a maximum size portion than the flat flexible tube. Therefore, the housing 10 can be reduced in size. In the flat type, moreover, after the linear portions contact with each other for shrinkage, even if they are further shrunk, the pressuring amount and the discharge amount are not proportional in a relation between them and the discharge amount is no longer accurate.

In the elastic deformation portion 23 shown in FIG. 3, three apices 41 are spaced 120 degrees apart and provided at regular intervals in the circumferential direction. However, the three apices 41 may be deviated somewhat from 120 degrees as far as the apices 41 are not dislocated radially at a time of shrinking and the convex arc portion 42 deforms elastically from the apex 41 as a center of deformation so that the opposite surfaces of the convex arc portions 42 approach to each other and folded in the circumferential direction.

Figure 5:
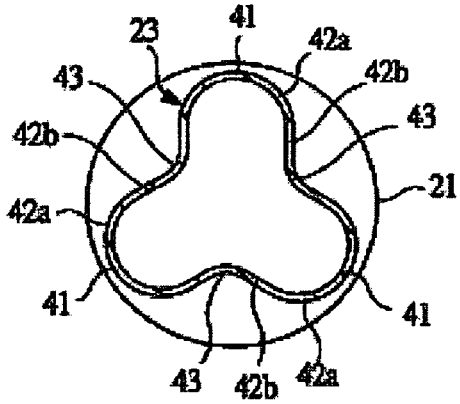
FIG. 5 is a sectional view showing a modified example of the flexible tube.

FIG. 5 is a sectional view showing the elastic deformation portion 23 in a modified example of the flexible tube 20. While the convex arc portion 42 of the elastic deformation portion 23 shown in FIG. 3 has an angle smaller than a semicircle, a convex arc portion 42 shown in FIG. 5 has semicircular portions 42*a* and straight portions 42*b*, wherein the convex arc portion 42 is formed by the semicircular portions 42*a* and the straight portions 42*b* and each straight portion 42*b* is consecutive to the concave arc portion 43.

Figure 6:
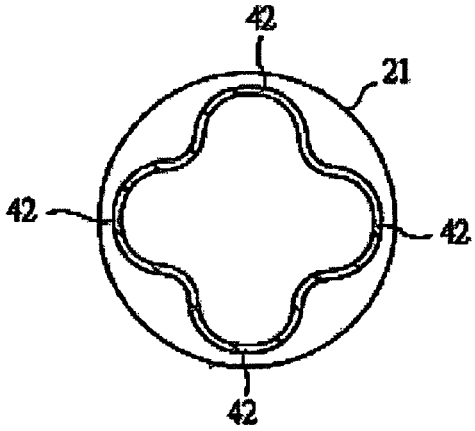
FIG. 6 is a sectional view showing a flexible tube as a comparative example.

FIG. 6 is a sectional view showing an elastic deformation portion of a flexible tube illustrated as a comparative example. In this elastic deformation portion 23, four convex arc portions 42 spaced approximately 90 degrees apart in the circumferential direction are provided. As shown in FIG. 6, to shrink the elastic deformation portion 23, each apex 41 must be dislocated toward the center in the inner-radial direction, so that large pressure is required for discharging a specified volume of liquid after completion of shrinkage. When the large pressure is applied to the pressurizing chamber, any large pressure is applied also to the housing 10. Therefore, in addition to occurrence of pressure transmission loss, the elastic deformation amount of the flexible tube 20 is not changed linearly with respect to pressure changes, and the pressure change rate and the elastic deformation rate are not made constant depending on a deformation state of the tube, so that a difference between the rates occurs easily. Further, the housing or other components are deformed by the pressure, whereby an influence on discharge precision is greater than that when the pressure is low. As a result, it was proved by the experiment that the discharge rate could not be set with high precision.

Therefore, as shown in FIG. 3 and FIG. 4, when the sectional shape of the elastic deformation portion 23 is trifoliate, the apex 41 is not dislocated radially at the time of deforming for shrinkage and each convex arc portion 42 is folded for deformation in the circumferential direction from the apex 41 as a center of deflection, so that the elastic deformation portion 23 can be deformed without applying the large pressure to the pressurizing chamber 25. Accordingly, the liquid discharge rate can be made constant from start to end of deformation of the elastic deformation portion 23, and the liquid can be discharged at a constant volume with high precision.

Figure 7A:
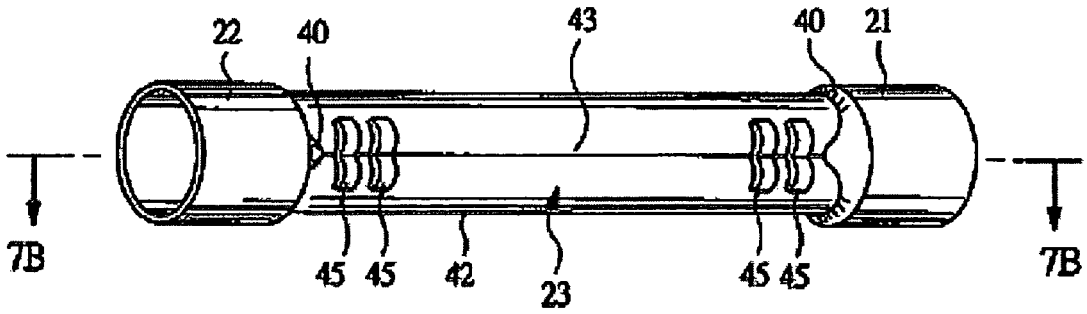
FIG. 7A is a perspective view showing a modified example of the flexible tube.
Figure 7B:
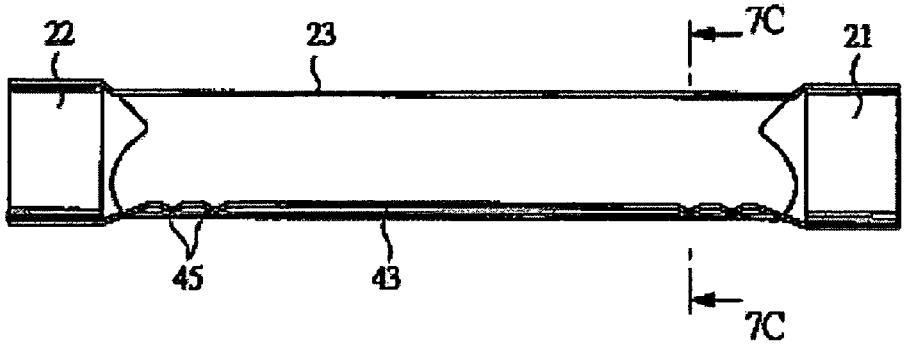
FIG. 7B is a sectional view taken along line 7B-7B in FIG. 7A.
Figure 7C:
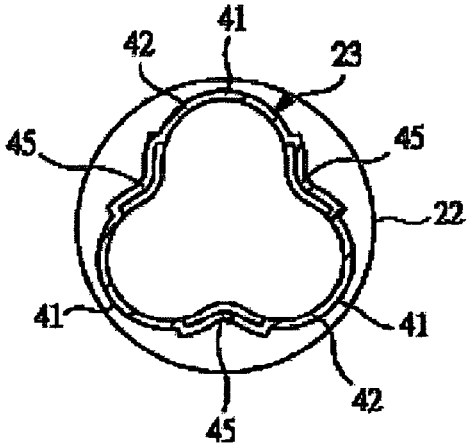
FIG. 7C is a sectional view taken along line 7C-7C in FIG. 7A.

FIGS. 7A to 7C each are a view showing another specific example of the flexible tube of the present invention, in which at both ends of the elastic deformation portion 23, axial deformation portions 45 are formed so as to be curved and project in an outer-radial direction. As shown in FIG. 7C, the axial deformation portions 45 are each formed into an arc and projects circumferentially so as to reach a portion of the convex arc portion 42 from the concave arc portion 43 as a center. In the flexible tube 20 shown in FIGS. 7A to 7C, since two axial deformation portions 45 are formed at each of both ends of the elastic deformation portion 23, a total of 12 axial deformation portions 45 are formed. This number of the axial deformation portion 45 may be, however, set freely depending on thickness or length or the like of the flexible tube 20.

If the elastic deformation portion 23 shrinks at the time of compressing the flexible tube 20, a tensile force acts axially on the elastic deformation portion 23 and a tensile strain occurs in the elastic deformation portion 23. At this time, since the axial deformation portions 45 deform axially so as to be flat, the elastic deformation portion 23 can be shrunk by relatively low pressure.

Figure 8A:
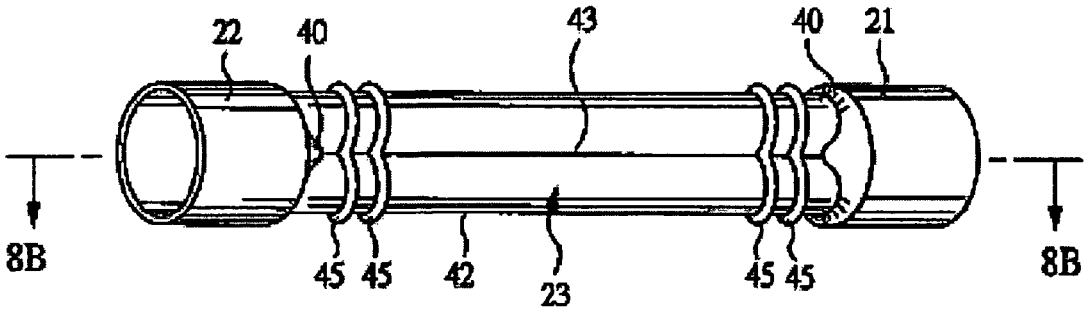
FIG. 8A is a perspective view showing a modified example of the flexible tube.
Figure 8B:
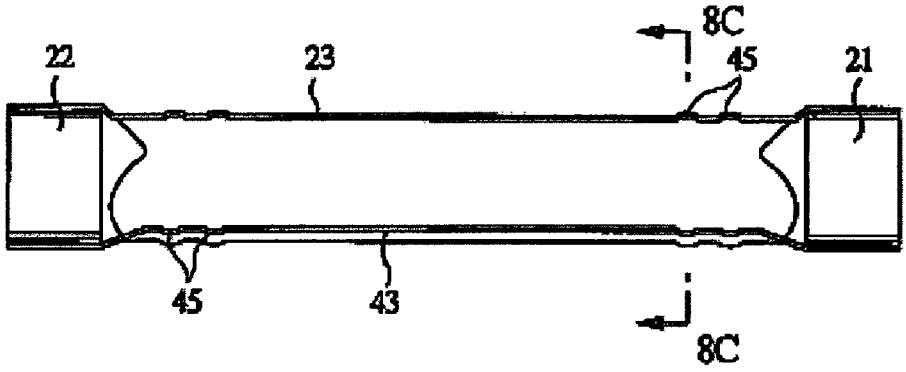
FIG. 8B is a sectional view taken along line 8B-8B in FIG. 8A.
Figure 8C:
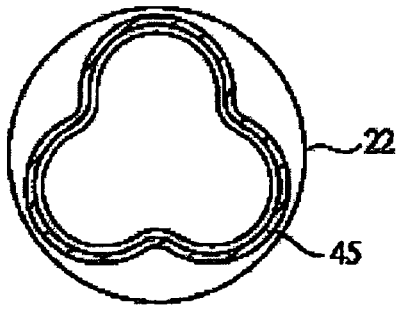
FIG. 8C is a sectional view taken along line 8C-8C in FIG. 8B.

FIG. 8 is a view showing another specific example of the flexible tube according to the present invention, in which at both ends of the elastic deformation portion 23, two pair axial deformation portions 45 are each formed consecutively into rings on all circumference of the elastic deformation portion 23. However, the number of axial deformation portions 45 is not limited to two pairs, and may be set to an arbitrary number. Thus, by forming the axial deformation portions 45 consecutively into a loop at all the circumference, like the case of FIG. 7, the axial deformation portions 45 deform when the elastic deformation portion 23 is shrunk, so that the elastic deformation portion 23 can be shrunk by applying relatively low pressure thereto.

The axial deformation portions 45 are provided at both ends of the elastic deformation portion 23 in the cases shown in FIG. 7 and FIG. 8. However, the axial deformation portions 45 are not limited to the above structure, and may be provided in an axial-directional center of the elastic deformation portion 23, or on the entire elastic deformation portion 23.

The present invention is not limited to the above-mentioned embodiments, and may be variously modified within the scope of not departing from the gist thereof. For example, the material of flexible tube 20 is not limited to a fluoro resin, and PP (polycarbonate), PC (polypropylene), and polyethylene, etc. may be used depending on some kinds of liquid to be discharged.

INDUSTRIAL APPLICABILITY

The flexible tube of the present invention is assembled in the chemical liquid supply apparatus. The chemical liquid supply apparatus is used for applying a chemical liquid such as a photoresist liquid to the semiconductor wafer or the like in a manufacturing process of semiconductor devices or liquid crystal board.

The invention claimed is:

1. A flexible tube for supplying a chemical liquid, which is assembled in a chemical liquid supply apparatus and partitions an internal expansion/shrinkage chamber inside the tube and an external pressurizing chamber outside the tube, said tube comprising:

a tubular inlet side end fixed to the chemical liquid supply apparatus, a tubular outlet side end fixed to the chemical liquid supply apparatus, and an elastic deformation portion between the inlet and outlet side fixed ends, the inlet and outlet side fixed ends and the elastic deformation portion forming principal parts of the flexible tube, and the flexible tube being formed of a resin; and the elastic deformation portion in an undeformed condition including convex arc portions whose deformation centers are three apices spaced apart at approximately regular intervals in a circumferential direction of the flexible tube and which are curved in convex shapes so as to have a smaller curvature radius than that of a virtual circle tangent to the apices, and concave arc portions located inwardly of and between the convex arc portions and joined consecutively between the respective convex arc portions to form a closed deformable shape, wherein an increase in the volume of the pressurizing chamber causes a shrinking deformation of the elastic deformation portion from its undeformed condition to expel fluid from the internal chamber, the shrinking deformation being characterized in that the convex arc portions elastically deform in the circumferential direction from the apices as centers without significant radial displacement of the apices, and the concave arc portions elastically deform in a radial direction, and thereafter a decrease in the volume of the pressurizing chamber allows the elastic deformation portion to return to its undeformed condition, by the elasticity of the flexible tube itself, thereby ingesting fluid into the internal chamber.

2. A flexible tube for supplying a chemical liquid, according to claim 1, further comprising:

axial deformation portions formed so as to extend to the concave arc portions of the elastic deformation portion and be axially deformed elastically by expansion and shrinkage of the elastic deformation portions.

3. The flexible tube for supplying a chemical liquid according to claim 2, wherein the axial deformation portions are formed on all circumference of the elastic deformation portion.

4. The flexible tube for supplying a chemical liquid according to claim 2, wherein the axial deformation portions are formed at both ends of the elastic deformation portion.

* * * * *